US010504352B2

(12) United States Patent
Wilkinson et al.

(10) Patent No.: US 10,504,352 B2
(45) Date of Patent: Dec. 10, 2019

(54) METHOD AND APPARATUS FOR MONITORING PERSON AND HOME

(71) Applicant: Walmart Apollo, LLC, Bentonville, AR (US)

(72) Inventors: Bruce W. Wilkinson, Rogers, AR (US); Todd D. Mattingly, Bentonville, AR (US)

(73) Assignee: Walmart Apollo, LLC, Bentonville, AR (US)

( * ) Notice: Subject to any disclaimer, the term of this patent is extended or adjusted under 35 U.S.C. 154(b) by 0 days.

(21) Appl. No.: 16/211,833

(22) Filed: Dec. 6, 2018

(65) Prior Publication Data

US 2019/0114896 A1 Apr. 18, 2019

Related U.S. Application Data

(63) Continuation of application No. 15/642,738, filed on Jul. 6, 2017, now Pat. No. 10,169,971.

(Continued)

(51) Int. Cl.
*G08B 21/04* (2006.01)

(52) U.S. Cl.
CPC ..... *G08B 21/0423* (2013.01); *G08B 21/0492* (2013.01)

(58) Field of Classification Search
CPC ..... G08B 21/0423; G08B 21/0492

(Continued)

(56) References Cited

U.S. PATENT DOCUMENTS 5,410,471 A 4/1995 Alyfuku
6,583,720 B1 6/2003 Quigley (Continued)

FOREIGN PATENT DOCUMENTS

CN 203299604 11/2013
CN 203405712 1/2014

(Continued)

OTHER PUBLICATIONS

Jakkula, V. et al.; "Detecting Anomalous Sensor Events in Smart Home Data for Enhancing the Living Experience"; Proceedings AAAIWS'11-07 Proceedings of the 7th AAAI Conference on Artificial Intelligence and Smarter Living: The Conquest of Complexity; 2011; pp. 33-37.

(Continued)

*Primary Examiner* — Jack K Wang
(74) *Attorney, Agent, or Firm* — Fitch, Even, Tabin & Flannery LLP

(57) ABSTRACT

In some embodiments, apparatuses, systems, and methods are provided herein useful to detecting a deviation in a person's activity. In some embodiments, an apparatus comprises one or more sensors, the one or more sensors configured to monitor parameters associated with a person and the person's home, and a control circuit, the control circuit communicatively coupled to the one or more sensors and configured to receive, from the one or more sensors, values associated with the parameters, create, based on the values associated with the parameters, a spectral profile for the person, determine, based on the spectral profile and a routine base state for the person, that a combination of the values indicates a deviation, determine, based on the deviation, an alert, and cause transmission of the alert.

11 Claims, 7 Drawing Sheets

Related U.S. Application Data

(60) Provisional application No. 62/359,462, filed on Jul. 7, 2016.

(58) Field of Classification Search
USPC ..... 340/573.1
See application file for complete search history.

(56) References Cited

U.S. PATENT DOCUMENTS

| | | | | |
|---|---|---|---|---|
| 6,856,249 | B2 | 2/2005 | Strubbe | |
| 7,369,680 | B2 | 5/2008 | Trajkovic | |
| 7,508,307 | B2 | 3/2009 | Albert | |
| 7,766,829 | B2 | 8/2010 | Sloan | |
| 8,558,703 | B2 | 10/2013 | Edlund | |
| 8,803,366 | B2 | 8/2014 | Proud | |
| 8,968,195 | B2 | 3/2015 | Tran | |
| 9,036,019 | B2 | 5/2015 | Hanson | |
| 9,294,298 | B2 | 3/2016 | Lee | |
| 9,750,439 | B2 | 9/2017 | Doniger | |
| 2004/0030531 | A1 | 2/2004 | Miller | |
| 2006/0055543 | A1 | 3/2006 | Ganesh | |
| 2006/0183980 | A1 | 8/2006 | Yang | |
| 2007/0096927 | A1* | 5/2007 | Albert | G08B 1/08 340/573.1 |
| 2009/0128325 | A1 | 5/2009 | Ivanov | |
| 2012/0019378 | A1 | 1/2012 | Watson | |
| 2012/0083705 | A1* | 4/2012 | Yuen | A61B 5/0002 600/508 |
| 2013/0106604 | A1 | 5/2013 | Lee | |
| 2014/0266791 | A1 | 9/2014 | Lloyd | |
| 2016/0094703 | A1 | 3/2016 | Wernevi | |
| 2016/0171866 | A1 | 6/2016 | Dupasquier | |
| 2018/0136334 | A1* | 5/2018 | McManamon | G01S 17/58 |

FOREIGN PATENT DOCUMENTS

| | | |
|---|---|---|
| CN | 203745868 | 7/2014 |
| WO | 2007072579 | 6/2007 |
| WO | 2015171072 | 11/2015 |

OTHER PUBLICATIONS

PCT; App. No. PCT/US2017/040855: International Search Report and Written Opinion dated Sep. 13, 2017.

U.S. Appl. No. 15/642,738; Notice of Allowance dated Aug. 28, 2018.

U.S. Appl. No. 15/642,738; Office Action dated Mar. 23, 2018.

Yin, J. et al; "Sensor-Based Abnormal Human-Activity Detection"; IEEE Transactions on Knowledge and Data Engineering; vol. 20, Issue: 8; Jun. 27, 2008; pp. 1-25.

* cited by examiner

METHOD AND APPARATUS FOR MONITORING PERSON AND HOME

RELATED APPLICATION(S)

This application is a continuation of U.S. application Ser. No. 15/642,738, filed Jul. 6, 2017, which claims the benefit of U.S. Provisional Application No. 62/359,462, filed Jul. 7, 2016, which are all incorporated by reference in their entirety herein.

TECHNICAL FIELD

This invention relates generally to monitoring systems and, more particularly, to systems for monitoring deviations in a person's activity.

BACKGROUND

While people typically don't perform the same tasks each day, eat the same meals each day, travel to the same locations each day, etc., most people have fairly routine schedules. For example, although an individual may not eat the exact same meal for dinner every night, he or she may have a meal pattern that is relatively consistent from week-to-week or month-to-month. As another example, although an individual may not travel to the same locations every day, he or she may typically go to the grocery store on Mondays, to the gym on Tuesdays and Thursdays, and out to one of a select number of restaurants on Fridays. Oftentimes, a deviation from these routines or patterns may signal that something is wrong or that something has changed in the person's life. Consequently, a way to better understand a person's routines may be useful in predicting problems, or changes, with that person and/or his or her routines.

BRIEF DESCRIPTION OF THE DRAWINGS

Disclosed herein are embodiments of systems, apparatuses and methods pertaining detecting a deviation in a person's activity. This description includes drawings, wherein.

Elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to various embodiments, systems, apparatuses, and methods are provided herein useful to detecting a deviation in a person's activity. In some embodiments, an apparatus comprises one or more sensors, the one or more sensors configured to monitor parameters associated with a person and the person's home, and a control circuit, the control circuit communicatively coupled to the one or more sensors and configured to receive, from the one or more sensors, values associated with the parameters, determine, based on the values, that a combination of the values indicates a deviation, determine, based on the deviation, an alert, and cause transmission of the alert.

Figure 1:
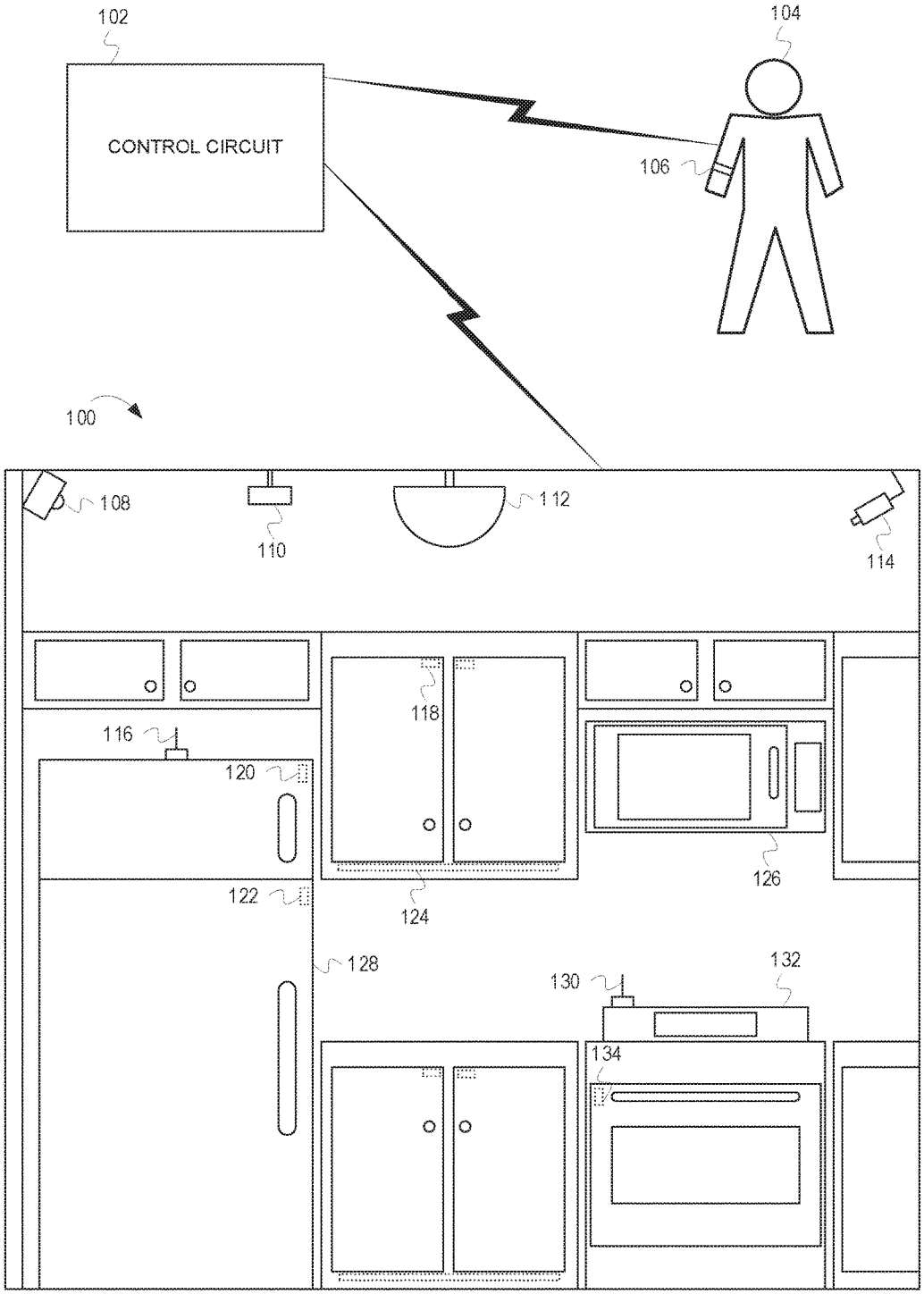
FIG. 1 is a diagram of a person 104 and a portion of his or her home 100 including multiple sensors, according to some embodiments.

As previously discussed, most people have fairly routine schedules from day-to-day, week-to-week, month-to-month, etc. Further, understanding a person's routines may be useful in detecting problems, or changes, with that person and/or his or her routines. For example, if a person who normally goes to the gym on Tuesdays and Thursdays stops going to the gym on Tuesdays and Thursdays, it may indicate that he or she isn't feeling well or has decided that going to the gym is not worth the effort. In addition to determining a deviation (e.g., no longer going to the gym), an alert can be sent indicating that he or she is no longer going to the gym. For example, the person could set an alert to be sent to his or her friend so that his or her friend will know he or she is no longer going to the gym and attempt to motivate him or her to resume going to the gym. Described herein are systems, methods, and apparatuses that can monitor a person and his or her environment, determine that the person has deviated from his or her normal routine, and cause an alert to be transmitted that indicates that there has been a deviation. FIG. 1 provides some background information for such a system.

FIG. 1 is a diagram of a person 104 and a portion of his or her home 100 including multiple sensors, according to some embodiments. The person's 104 home 100 includes a variety of different sensors. The sensors can include motion sensors, image sensors, noise sensors, light sensors, weight sensors, usage sensors, door sensors, or any other suitable type of sensor. Additionally, the person 104 can wear, or otherwise host, sensors on or in his or her body.

The portion of the person's 104 home 100 depicted in FIG. 1 is the kitchen. The kitchen includes a motion sensor 108, a noise sensor 110 (e.g., a microphone), a light sensor housed within a light fixture 112, an image sensor 114 (e.g., a video camera or a still camera), cabinet door sensors 118, and cabinet weight sensors 124. The motion sensor 108 can monitor motion and activity within the kitchen. The noise sensor 110 can monitor noise within the kitchen. The cabinet door sensors 118 can monitor opening and closing and/or the state (e.g., open or closed) of the cabinet door(s). The cabinet weight sensors 124 can monitor items within the cabinet. For example, the weight sensors 124 may span a portion of the cabinet's footprint that is large enough to accommodate several items. In such embodiments, the cabinet weight sensor 124 may generally monitor the weight of items in the cabinet. In other embodiments, the cabinet weight sensor 124 may include multiple smaller weight sensors. In such embodiments the person 104 can arrange items in the cabinet so that the cabinet weight sensors 124 can monitor how much of an item remains, or the presence of an item in the cabinet. The light sensor can monitor light in the kitchen and/or energy usage of the light fixture 112.

The appliances within the kitchen can also include a variety of sensors. For example, a refrigerator 128 includes a freezer door sensor 120 and a refrigerator door sensor 122 and an oven 132 includes an over door sensor 134. Although not depicted, the oven 132, refrigerator 128, and microwave 126 can also include usage sensors (e.g., energy usage, operational time, operational parameters, etc.) and/or weight sensors similar to the cabinet weight sensors 124 included in the cabinet. While FIG. 1 depicts only the person's 104 kitchen, the rest of the home 100 can also include sensors similar to those depicted in the kitchen.

In FIG. 1, the person 104 is wearing a fitness band 106. The fitness band 106 can include a plurality of sensors that can monitor the person's 104 vital signs, bodily functions, location, activity, etc. For example, the fitness band 106 can include a pedometer, an accelerometer, a motion sensor, a heart rate sensor, an image sensor, a noise sensor, an activity sensor, a blood pressure sensor, a location sensor (e.g., a GPS transceiver), etc. Although FIG. 1 only depicts the person 104 as wearing the fitness band 106, in some embodiments, the person can wear (or otherwise possess) additional sensor and/or devices having sensors.

The sensors, or an appliance associated with a sensor, can also include a transmitter (or transceiver). For example, the refrigerator 128 includes a refrigerator transmitter 116 and the oven 132 includes an oven transmitter 130. Likewise, the fitness band 106 can include a transmitter. The sensors, as well as the transmitters, are operable to transmit data to a control circuit 102. The data can include values associated with parameters monitored by the sensors. The control circuit 102 monitors and processes the data. The control circuit 102 processes the data to determine deviations from the person's normal routine. In some embodiments, the control circuit 102 may require a learning phase during set up. In such embodiments, the control circuit 102 processes the data to learn the person's 104 normal routine. Upon detecting a deviation from the person's 104 normal routine, the control circuit 102 can determine a type of alert that is appropriate based on the deviation as well as an appropriate recipient for the alert. The control circuit 102 can also transmit, or cause transmission of, the alert to the recipient.

Figure 2:
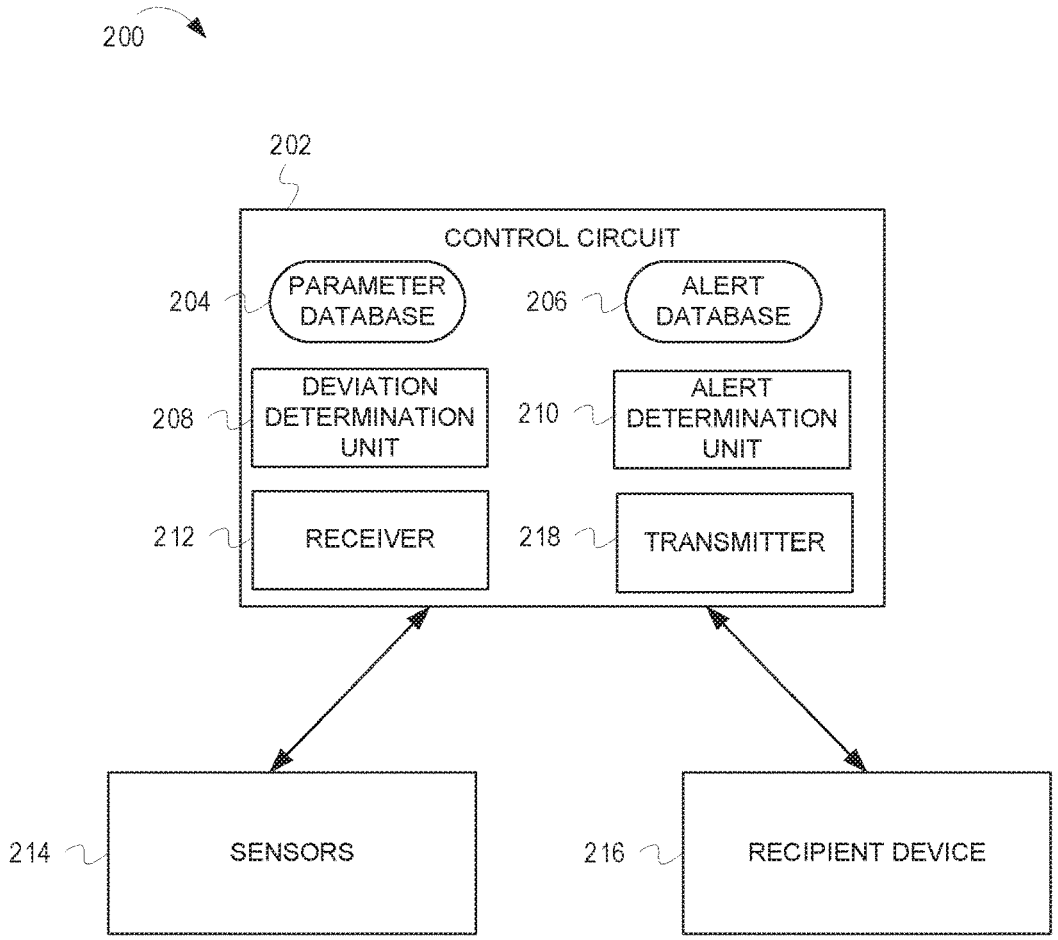
FIG. 2 is a block diagram of a system 200 for detecting a deviation in a person's activity, according to some embodiments.

While FIG. 1 and the related text provide background information about a system that can detect deviations from a person's normal routine and transmit alerts based on the deviations, FIG. 2 and the related text describe an example system that can detect deviations from a person's normal routine and transmit alerts based on the deviations.

FIG. 2 is a block diagram of a system 200 for detecting a deviation in a person's activity, according to some embodiments. The system 200 includes a control circuit 202, sensors 214, and a recipient device 216. The sensors 214 can be any type, and number, of sensors suitable for monitoring parameters associated with a person and indicative of, or associated with, his or her activities. The sensors 214 are in communication with the control circuit 202 and transmit data to the control circuit 202 for processing. The data can include values associated with the parameters.

The control circuit 202 can comprise a fixed-purpose hard-wired hardware platform (including but not limited to an application-specific integrated circuit (ASIC) (which is an integrated circuit that is customized by design for a particular use, rather than intended for general-purpose use), a field-programmable gate array (FPGA), and the like) or can comprise a partially or wholly-programmable hardware platform (including but not limited to microcontrollers, microprocessors, and the like). These architectural options for such structures are well known and understood in the art and require no further description here. The control circuit 202 is configured (for example, by using corresponding programming as will be well understood by those skilled in the art) to carry out one or more of the steps, actions, and/or functions described herein.

By one optional approach the control circuit 202 operably couples to a memory. The memory may be integral to the control circuit 202 or can be physically discrete (in whole or in part) from the control circuit 202 as desired. This memory can also be local with respect to the control circuit 202 (where, for example, both share a common circuit board, chassis, power supply, and/or housing) or can be partially or wholly remote with respect to the control circuit 202 (where, for example, the memory is physically located in another facility, metropolitan area, or even country as compared to the control circuit 202).

This memory can serve, for example, to non-transitorily store the computer instructions that, when executed by the control circuit 202, cause the control circuit 202 to behave as described herein. As used herein, this reference to "non-transitorily" will be understood to refer to a non-ephemeral state for the stored contents (and hence excludes when the stored contents merely constitute signals or waves) rather than volatility of the storage media itself and hence includes both non-volatile memory (such as read-only memory (ROM) as well as volatile memory (such as an erasable programmable read-only memory (EPROM).

The control circuit 202 includes a parameter database 204, an alert database 206, a deviation determination unit 208, an alert determination unit 210, a receiver 212, and a transmitter 218. Although depicted as individual units, in some embodiments the receiver 212 and the transmitter 218 can be a single unit, such as a transceiver. The parameter database 204 includes the parameters that are, or can be, monitored by the sensors 214. As one example, the parameter database 204 can include an array of the parameters and the types of sensors 214 with which the parameters are associated. In some embodiments, the parameter database 204, or another database (e.g., a dedicated user database), can include an array of users and the sensors associated with the user's account, as well and information about each user's routines.

The deviation determination unit 208 processes the data from the sensors 214 to determine if a deviation has occurred with regard to a user's routine. The deviation determination unit 208 can make this determination by accessing the parameter database 204, as well as other databases that may contain user information. The alert database 206 includes possible alerts. For example, the alert database 206 can include a list of all possible alerts and what conditions prompt each of the alerts. In some embodiments, the alert database 206, or another database (e.g., a dedicated user database) can include alerts, and recipients, associated with each user. The users can configure what types of alerts should be associated with different types of deviations as well as who the recipient should be for each deviation. Additionally, some or all of the alerts and recipients can be standardized or preconfigured for the users. After the deviation determination unit 208 determines that the user has deviated from his or her routine, the alert determination unit 210 determines an appropriate alert. Additionally, the alert determination unit 210 can determine the appropriate recipient for the alert. The transmitter 218 then transmits the alert to the recipient device 216.

Figure 3:
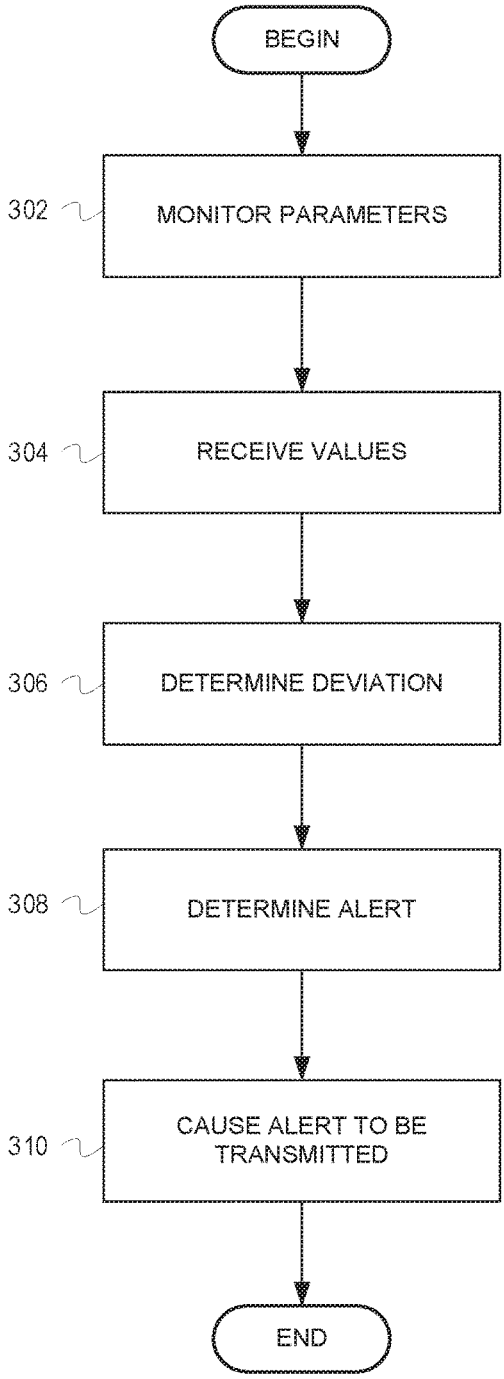
FIG. 3 is a flow chart depicting example operations for detecting a deviation in a person's activity, according to some embodiments.

While FIG. 2 and the related text describe an example system that can detect deviations from a person's normal routine and transmit alerts based on the deviations, FIG. 3 and the related text describe example operations for performed by such a system.

FIG. 3 is a flow chart depicting example operations for detecting a deviation in a person's activity, according to some embodiments. The flow begins at block 302.

At block 302, parameters are monitored. For example, a plurality of sensors monitor parameters that are associated with a person and his or her environment and activities. The plurality of sensors can include sensors that monitor the person and his or her activity and location as well as sensors within the person home or car that monitor the person's environment. The flow continues at block 304.

At block 304, values are received. For example, a control circuit can receive the values from one or more of the plurality of sensors. The values can be associated with the parameters monitored by the plurality of sensors. For example, the values can indicate information about the person such as his or her heartrate, blood pressure, body temperature, current activity, past activity, location, etc. The values can also indicate information about the person's environment such as room temperature, appliance usage, cabinet or refrigerator contents, energy usage, noise level, humidity level, occupants, etc. The flow continues at block 306.

At block 306, a deviation is determined. For example, the control circuit can determine that there has been a deviation from the person's routine. The control circuit can determine deviations based on a single value, for example, being above a threshold, below a threshold, out of range, etc. Additionally, in some embodiments, the control circuit can determine deviations based on multiple values. For example, each of the multiple values may be above or below a threshold or out of range. As another example, each of the multiple values may be within a normal or expected range, but the values in the aggregate may indicate a deviation. For example, the values may indicate that the person's pulse is 140 BPM and that the person is not currently engaged in physical exercise. While a heartrate of 140 BPM is high, it is not necessarily outside of a normal range and may not be out the person's normal or expected range. Additionally, that the person is not currently engaged in physical activity is not abnormal. However, the relatively high heartrate coupled with the lack of physical exercise may be a deviation that indicates a problem. In some embodiments, the control circuit references only the person's information to determine if there is a deviation. In other embodiments, the control circuit can aggregate data over time and from any number of users to determine trends in a larger population. In such embodiments, the control circuit can use this aggregated information to determine if there is a deviation. The flow continues at block 308.

At block 308, an alert is determined. For example, the control circuit can determine a type of alert. The type of alert can be based on the deviation and/or the values. More specifically, the type of alert can be based on the magnitude of the variance in the values from their expected value. For example, if the person typically gets out of bed at 7 A, at 9 A the control circuit may simply select an alert such as a wakeup call to the person. However, if the person typically gets out of bed at 7 A and it is 9 P, the control circuit may select an alert to notify a local police department to request a wellness check. The control circuit can also determine a recipient for the alert. The recipients can include the person, family members, friends, emergency personnel, retailers, etc. The control circuit can determine a recipient based upon user specifications, data from other users, preset configurations, etc. The control circuit can also determine a mode of transmission of the alert. For example, the alert can be a phone call, a text message, an email, a page, a social media message, a product shipment, etc. For example, if the control circuit determines that the person typically has pasta with dinner on Tuesdays, leaves the office around 6 P, and that there is not sufficient pasta in the person's home to support this meal, the alert can be an order to a retailer for more pasta. The flow continues at block 310.

At block 310, the alert is transmitted. For example, the control circuit can cause transmission of the alert. The control circuit can cause transmission of the alert by sending the alert, or providing a signal (e.g., including the alert and instructions) to a transmitter.

Figure 4:
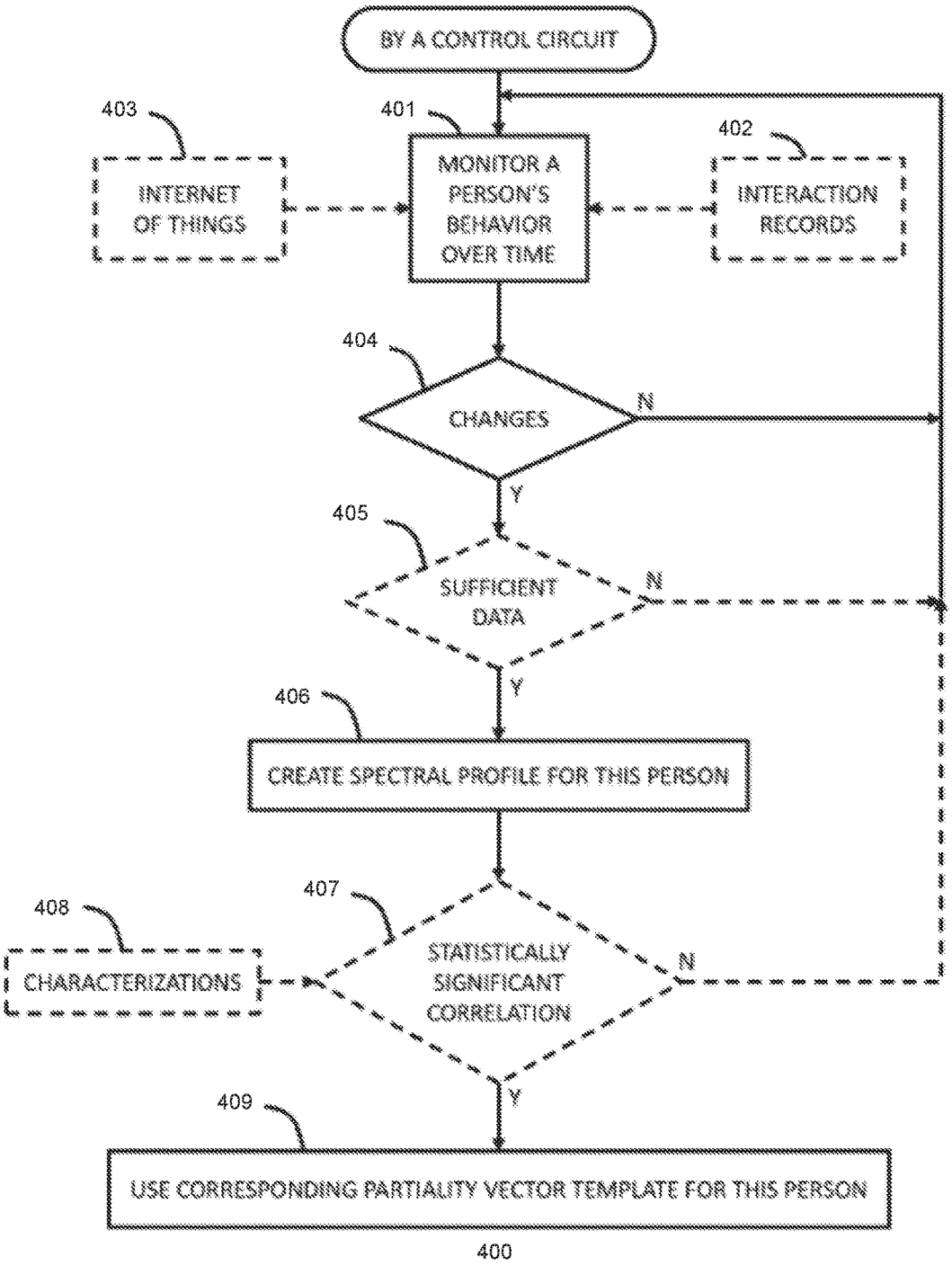
FIG. 4 comprises a flow diagram as configured in accordance with various embodiments of these teachings.

FIG. 4 presents a process 400 that illustrates yet another approach in these regards. For the sake of an illustrative example it will be presumed here that a control circuit of choice (with useful examples in these regards being presented further below) carries out one or more of the described steps/actions.

At block 401 the control circuit monitors a person's behavior over time. The range of monitored behaviors can vary with the individual and the application setting. By one approach, only behaviors that the person has specifically approved for monitoring are so monitored.

As one example in these regards, this monitoring can be based, in whole or in part, upon interaction records 402 that reflect or otherwise track, for example, the monitored person's purchases. This can include specific items purchased by the person, from whom the items were purchased, where the items were purchased, how the items were purchased (for example, at a brick-and-mortar physical retail shopping facility or via an on-line shopping opportunity), the price paid for the items, and/or which items were returned and when), and so forth.

As another example in these regards the interaction records 402 can pertain to the social networking behaviors of the monitored person including such things as their "likes," their posted comments, images, and tweets, affinity group affiliations, their on-line profiles, their playlists and other indicated "favorites," and so forth. Such information can sometimes comprise a direct indication of a particular partiality or, in other cases, can indirectly point towards a particular partiality and/or indicate a relative strength of the person's partiality.

Other interaction records of potential interest include but are not limited to registered political affiliations and activities, credit reports, military-service history, educational and employment history, and so forth.

As another example, in lieu of the foregoing or in combination therewith, this monitoring can be based, in whole or in part, upon sensor inputs from the Internet of Things (TOT) 503. The Internet of Things refers to the Internet-based inter-working of a wide variety of physical devices including but not limited to wearable or carriable devices, vehicles, buildings, and other items that are embedded with electronics, software, sensors, network connectivity, and sometimes actuators that enable these objects to collect and exchange data via the Internet. In particular, the Internet of Things allows people and objects pertaining to people to be sensed and corresponding information to be transferred to remote locations via intervening network infrastructure. Some experts estimate that the Internet of Things will consist of almost 50 billion such objects by 2020. (Further description in these regards appears further herein.)

Depending upon what sensors a person encounters, information can be available regarding a person's travels, lifestyle, calorie expenditure over time, diet, habits, interests and affinities, choices and assumed risks, and so forth. This process 400 will accommodate either or both real-time or non-real time access to such information as well as either or both push and pull-based paradigms.

By monitoring a person's behavior over time, a general sense of that person's daily routine can be established (sometimes referred to herein as a routine experiential base state). As a very simple illustrative example, a routine experiential base state can include a typical daily event timeline for the person that represents typical locations that the person visits and/or typical activities in which the person engages. The timeline can indicate those activities that tend to be scheduled (such as the person's time at their place of employment or their time spent at their child's sports practices) as well as visits/activities that are normal for the person though not necessarily undertaken with strict observance to a corresponding schedule (such as visits to local stores, movie theaters, and the homes of nearby friends and relatives).

At block 404 this process 400 provides for detecting changes (i.e., deviations) to that established routine. These teachings are highly flexible in these regards and will accommodate a wide variety of "changes." Some illustrative examples include but are not limited to changes with respect to a person's travel schedule, destinations visited or time spent at a particular destination, the purchase and/or use of new and/or different products or services, a subscription to a new magazine, a new Rich Site Summary (RSS) feed or a subscription to a new blog, a new "friend" or "connection" on a social networking site, a new person, entity, or cause to follow on a Twitter-like social networking service, enrollment in an academic program, and so forth.

Upon detecting a change, at optional block 405 this process 400 will accommodate assessing whether the detected change constitutes a sufficient amount of data to warrant proceeding further with the process. This assessment can comprise, for example, assessing whether a sufficient number (i.e., a predetermined number) of instances of this particular detected change have occurred over some predetermined period of time. As another example, this assessment can comprise assessing whether the specific details of the detected change are sufficient in quantity and/or quality to warrant further processing. For example, merely detecting that the person has not arrived at their usual 6 PM-Wednesday dance class may not be enough information, in and of itself, to warrant further processing, in which case the information regarding the detected change may be discarded or, in the alternative, cached for further consideration and use in conjunction or aggregation with other, later-detected changes.

Figure 5:
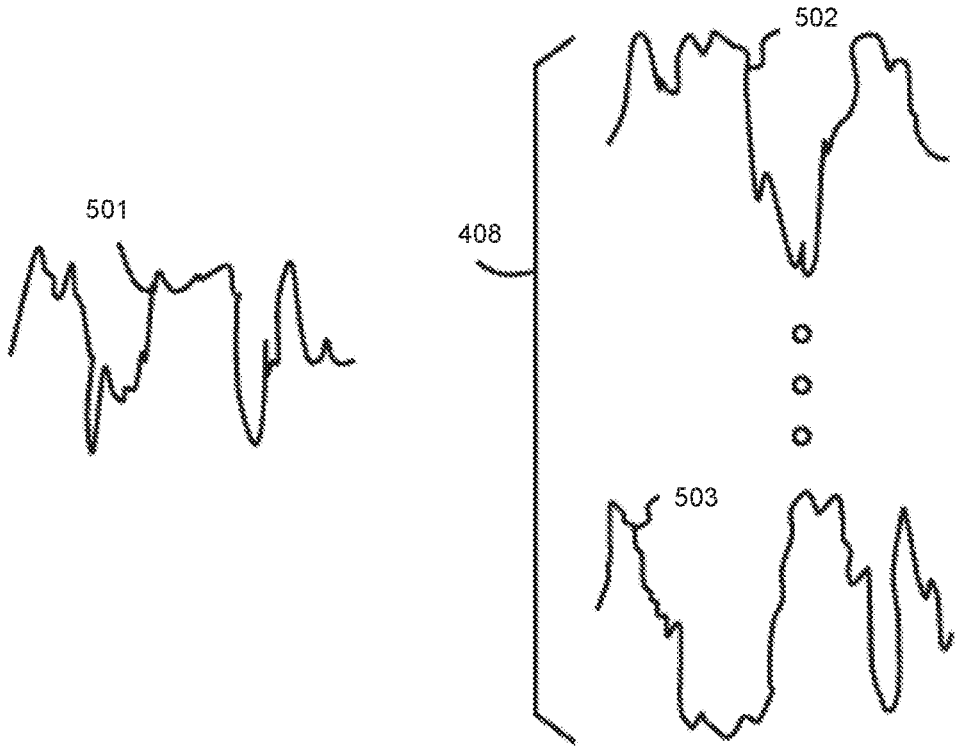
FIG. 5 comprises a graphic representation as configured in accordance with various embodiments of these teachings.

At block 406 this process 400 uses these detected changes to create a spectral profile for the monitored person. FIG. 5 provides an illustrative example in these regards with the spectral profile denoted by reference numeral 601. In this illustrative example the spectral profile 501 represents changes to the person's behavior over a given period of time (such as an hour, a day, a week, or some other temporal window of choice). Such a spectral profile can be as multidimensional as may suit the needs of a given application setting.

At optional block 407 this process 400 then provides for determining whether there is a statistically significant correlation between the aforementioned spectral profile and any of a plurality of like characterizations 408. The like characterizations 408 can comprise, for example, spectral profiles that represent an average of groupings of people who share many of the same (or all of the same) identified partialities. As a very simple illustrative example in these regards, a first such characterization 502 might represent a composite view of a first group of people who have three similar partialities but a dissimilar fourth partiality while another of the characterizations 503 might represent a composite view of a different group of people who share all four partialities.

The aforementioned "statistically significant" standard can be selected and/or adjusted to suit the needs of a given application setting. The scale or units by which this measurement can be assessed can be any known, relevant scale/unit including, but not limited to, scales such as standard deviations, cumulative percentages, percentile equivalents, Z-scores, T-scores, standard nines, and percentages in standard nines. Similarly, the threshold by which the level of statistical significance is measured/assessed can be set and selected as desired. By one approach the threshold is static such that the same threshold is employed regardless of the circumstances. By another approach the threshold is dynamic and can vary with such things as the relative size of the population of people upon which each of the characterizations 508 are based and/or the amount of data and/or the duration of time over which data is available for the monitored person.

Figure 6:
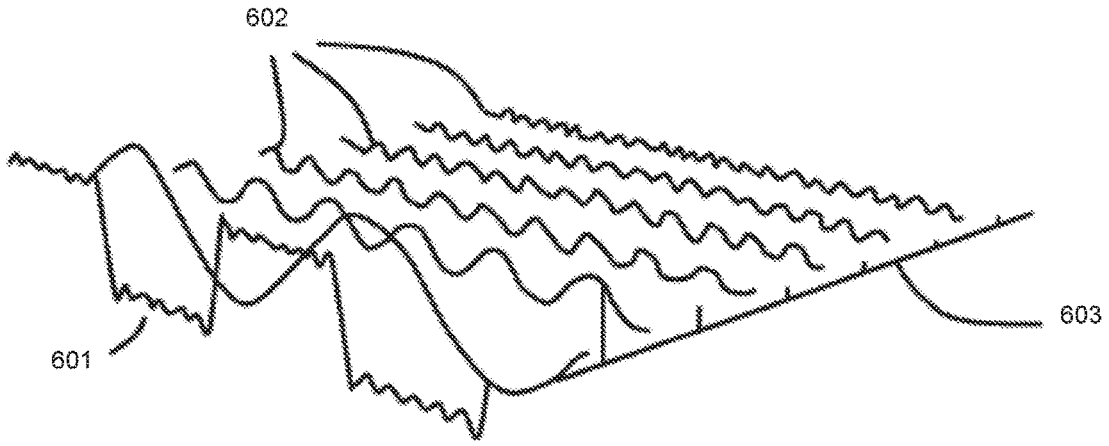
FIG. 6 comprises a graphic representation as configured in accordance with various embodiments of these teachings.

Referring now to FIG. 6, by one approach the selected characterization (denoted by reference numeral 601 in this figure) comprises an activity profile over time of one or more human behaviors. Examples of behaviors include but are not limited to such things as repeated purchases over time of particular commodities, repeated visits over time to particular locales such as certain restaurants, retail outlets, athletic or entertainment facilities, and so forth, and repeated activities over time such as floor cleaning, dish washing, car cleaning, cooking, volunteering, and so forth. Those skilled in the art will understand and appreciate, however, that the selected characterization is not, in and of itself, demographic data (as described elsewhere herein).

More particularly, the characterization 601 can represent (in this example, for a plurality of different behaviors) each instance over the monitored/sampled period of time when the monitored/represented person engages in a particular represented behavior (such as visiting a neighborhood gym, purchasing a particular product (such as a consumable perishable or a cleaning product), interacts with a particular affinity group via social networking, and so forth). The relevant overall time frame can be chosen as desired and can range in a typical application setting from a few hours or one day to many days, weeks, or even months or years. (It will be understood by those skilled in the art that the particular characterization shown in FIG. 6 is intended to serve an illustrative purpose and does not necessarily represent or mimic any particular behavior or set of behaviors).

Generally speaking it is anticipated that many behaviors of interest will occur at regular or somewhat regular intervals and hence will have a corresponding frequency or periodicity of occurrence. For some behaviors that frequency of occurrence may be relatively often (for example, oral hygiene events that occur at least once, and often multiple times each day) while other behaviors (such as the preparation of a holiday meal) may occur much less frequently (such as only once, or only a few times, each year). For at least some behaviors of interest that general (or specific) frequency of occurrence can serve as a significant indication of a person's corresponding partialities.

By one approach, these teachings will accommodate detecting and timestamping each and every event/activity/behavior or interest as it happens. Such an approach can be memory intensive and require considerable supporting infrastructure.

The present teachings will also accommodate, however, using any of a variety of sampling periods in these regards. In some cases, for example, the sampling period per se may be one week in duration. In that case, it may be sufficient to know that the monitored person engaged in a particular activity (such as cleaning their car) a certain number of times during that week without known precisely when, during that week, the activity occurred. In other cases it may be appropriate or even desirable, to provide greater granularity in these regards. For example, it may be better to know which days the person engaged in the particular activity or even the particular hour of the day. Depending upon the selected granularity/resolution, selecting an appropriate sampling window can help reduce data storage requirements (and/or corresponding analysis/processing overhead requirements).

Although a given person's behaviors may not, strictly speaking, be continuous waves (as shown in FIG. 6) in the same sense as, for example, a radio or acoustic wave, it will nevertheless be understood that such a behavioral characterization 601 can itself be broken down into a plurality of sub-waves 602 that, when summed together, equal or at least approximate to some satisfactory degree the behavioral characterization 601 itself (The more-discrete and sometimes less-rigidly periodic nature of the monitored behaviors may introduce a certain amount of error into the corresponding sub-waves. There are various mathematically satisfactory ways by which such error can be accommodated including by use of weighting factors and/or expressed tolerances that correspond to the resultant sub-waves.)

It should also be understood that each such sub-wave can often itself be associated with one or more corresponding discrete partialities. For example, a partiality reflecting concern for the environment may, in turn, influence many of the included behavioral events (whether they are similar or dissimilar behaviors or not) and accordingly may, as a sub-wave, comprise a relatively significant contributing factor to the overall set of behaviors as monitored over time. These sub-waves (partialities) can in turn be clearly revealed and presented by employing a transform (such as a Fourier transform) of choice to yield a spectral profile 703 wherein the X axis represents frequency and the Y axis represents the magnitude of the response of the monitored person at each frequency/sub-wave of interest.

Figure 7:
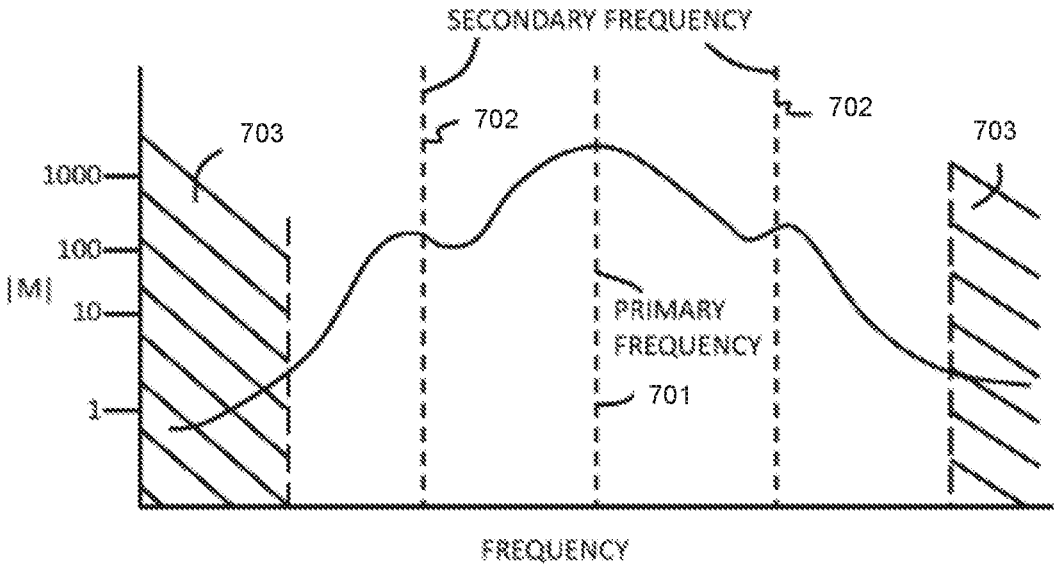
FIG. 7 comprises a graphic representation as configured in accordance with various embodiments of these teachings.

This spectral response of a given individual—which is generated from a time series of events that reflect/track that person's behavior—yields frequency response characteristics for that person that are analogous to the frequency response characteristics of physical systems such as, for example, an analog or digital filter or a second order electrical or mechanical system. Referring to FIG. 7, for many people the spectral profile of the individual person will exhibit a primary frequency 701 for which the greatest response (perhaps many orders of magnitude greater than other evident frequencies) to life is exhibited and apparent. In addition, the spectral profile may also possibly identify one or more secondary frequencies 802 above and/or below that primary frequency 701. (It may be useful in many application settings to filter out more distant frequencies 703 having considerably lower magnitudes because of a reduced likelihood of relevance and/or because of a possibility of error in those regards; in effect, these lower-magnitude signals constitute noise that such filtering can remove from consideration.)

As noted above, the present teachings will accommodate using sampling windows of varying size. By one approach the frequency of events that correspond to a particular partiality can serve as a basis for selecting a particular sampling rate to use when monitoring for such events. For example, Nyquist-based sampling rules (which dictate sampling at a rate at least twice that of the frequency of the signal of interest) can lead one to choose a particular sampling rate (and the resultant corresponding sampling window size).

As a simple illustration, if the activity of interest occurs only once a week, then using a sampling of half-a-week and sampling twice during the course of a given week will adequately capture the monitored event. If the monitored person's behavior should change, a corresponding change can be automatically made. For example, if the person in the foregoing example begins to engage in the specified activity three times a week, the sampling rate can be switched to six times per week (in conjunction with a sampling window that is resized accordingly).

By one approach, the sampling rate can be selected and used on a partiality-by-partiality basis. This approach can be especially useful when different monitoring modalities are employed to monitor events that correspond to different partialities. If desired, however, a single sampling rate can be employed and used for a plurality (or even all) partialities/behaviors. In that case, it can be useful to identify the behavior that is exemplified most often (i.e., that behavior which has the highest frequency) and then select a sampling rate that is at least twice that rate of behavioral realization, as that sampling rate will serve well and suffice for both that highest-frequency behavior and all lower-frequency behaviors as well.

It can be useful in many application settings to assume that the foregoing spectral profile of a given person is an inherent and inertial characteristic of that person and that this spectral profile, in essence, provides a personality profile of that person that reflects not only how but why this person responds to a variety of life experiences. More importantly, the partialities expressed by the spectral profile for a given person will tend to persist going forward and will not typically change significantly in the absence of some powerful external influence (including but not limited to significant life events such as, for example, marriage, children, loss of job, promotion, and so forth).

In any event, by knowing a priori the particular partialities (and corresponding strengths) that underlie the particular characterization 601, those partialities can be used as an initial template for a person whose own behaviors permit the selection of that particular characterization 601. In particular, those particularities can be used, at least initially, for a person for whom an amount of data is not otherwise available to construct a similarly rich set of partiality information.

As a very specific and non-limiting example, per these teachings the choice to make a particular product can include consideration of one or more value systems of potential customers. When considering persons who value animal rights, a product conceived to cater to that value proposition may require a corresponding exertion of additional effort to order material space-time such that the product is made in a way that (A) does not harm animals and/or (even better) (B) improves life for animals (for example, eggs obtained from free range chickens). The reason a person exerts effort to order material space-time is because they believe it is good to do and/or not good to not do so. When a person exerts effort to do good (per their personal standard of "good") and if that person believes that a particular order in material space-time (that includes the purchase of a particular product) is good to achieve, then that person will also believe that it is good to buy as much of that particular product (in order to achieve that good order) as their finances and needs reasonably permit (all other things being equal).

The aforementioned additional effort to provide such a product can (typically) convert to a premium that adds to the price of that product. A customer who puts out extra effort in their life to value animal rights will typically be willing to pay that extra premium to cover that additional effort exerted by the company. By one approach a magnitude that corresponds to the additional effort exerted by the company can be added to the person's corresponding value vector because a product or service has worth to the extent that the product/service allows a person to order material space-time in accordance with their own personal value system while allowing that person to exert less of their own effort in direct support of that value (since money is a scalar form of effort).

By one approach there can be hundreds or even thousands of identified partialities. In this case, if desired, each product/service of interest can be assessed with respect to each and every one of these partialities and a corresponding partiality vector formed to thereby build a collection of partiality vectors that collectively characterize the product/service. As a very simple example in these regards, a given laundry detergent might have a cleanliness partiality vector with a relatively high magnitude (representing the effectiveness of the detergent), a ecology partiality vector that might be relatively low or possibly even having a negative magnitude (representing an ecologically disadvantageous effect of the detergent post usage due to increased disorder in the environment), and a simple-life partiality vector with only a modest magnitude (representing the relative ease of use of the detergent but also that the detergent presupposes that the user has a modern washing machine). Other partiality vectors for this detergent, representing such things as nutrition or mental acuity, might have magnitudes of zero.

As mentioned above, these teachings can accommodate partiality vectors having a negative magnitude. Consider, for example, a partiality vector representing a desire to order things to reduce one's so-called carbon footprint. A magnitude of zero for this vector would indicate a completely neutral effect with respect to carbon emissions while any positive-valued magnitudes would represent a net reduction in the amount of carbon in the atmosphere, hence increasing the ability of the environment to be ordered. Negative magnitudes would represent the introduction of carbon emissions that increases disorder of the environment (for example, as a result of manufacturing the product, transporting the product, and/or using the product)

Those skilled in the art will recognize that a wide variety of other modifications, alterations, and combinations can also be made with respect to the above described embodiments without departing from the scope of the invention, and that such modifications, alterations, and combinations are to be viewed as being within the ambit of the inventive concept.

In some embodiments, an apparatus comprises one or more sensors, the one or more sensors configured to monitor parameters associated with a person and the person's home, and a control circuit, the control circuit communicatively coupled to the one or more sensors and configured to receive, from the one or more sensors, values associated with the parameters, create, based on the values associated with the parameters, a spectral profile for the person, determine, based on the spectral profile and a routine experiential base state for the person, that a combination of the values indicates a deviation, determine, based on the deviation, an alert, and cause transmission of the alert.

In some embodiments, a method comprises monitoring, via one or more sensors, parameters associated with a person and the person's home, receiving, at a control circuit from the one or more sensors, values associated with the parameters, creating, based on the values associated with the parameters, a spectral profile for the person, determining, based on the spectral profile and a routine experiential base state for the person, that a combination of the values indicates a deviation, determining, based on the deviation, an alert, and causing the alert to be transmitted.

The invention claimed is:

1. An apparatus for monitoring parameters associated with a person and the person's home, the apparatus comprising:

one or more sensors, the one or more sensors configured to monitor the parameters associated with the person and the person's home; and a control circuit, the control circuit communicatively coupled to the one or more sensors and configured to:

receive, from the one or more sensors, values associated with the parameters;

create, based on the values associated with the parameters, a time-based activity profile for the person;

use a transform function to transform the time-based activity profile to a frequency-based spectral profile;

use the frequency-based spectral profile to identify at least one partiality for the person, wherein the partiality for the person is associated with a partiality vector that characterizes the person's partiality for one or more of a product and a service.

2. The apparatus of claim 1 wherein the transform function comprises a Fourier transform function.

3. The apparatus of claim 1 wherein the control circuit is configured to use the frequency-based spectral profile to identify at least one partiality for the person by using the frequency-based spectral profile to identify a plurality of partialities for the person.

4. The apparatus of claim 1 wherein the control circuit is configured to use the frequency-based spectral profile to identify at least one partiality for the person by, at least in part, identifying a primary frequency.

5. The apparatus of claim 4 wherein the primary frequency represents the person's greatest response to life in the monitored parameters.

6. The apparatus of claim 4 wherein a sampling rate for at least one of the sensors is adjusted as a function of the primary frequency.

7. The apparatus of claim 4 wherein the control circuit is further configured to use the frequency-based spectral profile to identify at least one further partiality for the person by, at least in part, identifying at least a first secondary frequency.

8. The apparatus of claim 7 wherein the control circuit is further configured to filter out at least some secondary frequencies for having too low a relative magnitude and to not use such filtered-out secondary frequencies when identifying secondary frequencies.

9. The apparatus of claim 7 wherein a sampling rate for at least one of the sensors is adjusted as a function of the primary frequency and a sampling rate for at least another of the sensors is adjusted as a function of the at least one secondary frequency.

10. The apparatus of claim 7, wherein the partiality vector has at least one of a magnitude and an angle that corresponds to a magnitude of the person's belief in an amount of good that comes from an order associated with the at least one partiality.

11. The apparatus of claim 1, wherein the one or more of a product and a service have a vector, wherein the vector characterizes the one or more of a product and a service.

* * * * *